US009146032B2

(12) United States Patent
Maxwell

(10) Patent No.: US 9,146,032 B2
(45) Date of Patent: Sep. 29, 2015

(54) SYSTEM AND METHOD FOR LIGHTING TOILET WASTE AREA

(71) Applicant: Mark J. Maxwell, Reno, NV (US)

(72) Inventor: Mark J. Maxwell, Reno, NV (US)

( * ) Notice: Subject to any disclaimer, the term of this patent is extended or adjusted under 35 U.S.C. 154(b) by 8 days.

(21) Appl. No.: 13/767,567

(22) Filed: Feb. 14, 2013

(65) Prior Publication Data

US 2013/0208452 A1 Aug. 15, 2013

Related U.S. Application Data

(60) Provisional application No. 61/598,479, filed on Feb. 14, 2012.

(51) Int. Cl.

| | |
|---|---|
| ***F21V 33/00*** | (2006.01) |
| *E03D 5/10* | (2006.01) |
| *F21K 99/00* | (2010.01) |
| *F21S 9/02* | (2006.01) |
| *F21V 23/04* | (2006.01) |
| *F21Y 101/02* | (2006.01) |
| *F21Y 113/00* | (2006.01) |
| *F21S 10/02* | (2006.01) |

(52) U.S. Cl.

CPC ..... *F21V 33/004* (2013.01); *E03D 5/105* (2013.01); *F21K 9/58* (2013.01); *F21S 9/02* (2013.01); *F21S 10/023* (2013.01); *F21V 23/0435* (2013.01); *F21Y 2101/02* (2013.01); *F21Y 2113/005* (2013.01)

(58) Field of Classification Search

CPC ..... F21V 33/004; F21V 23/0442; E03D 9/00; E03D 5/105; F21K 99/00; F21K 9/58; F21S 10/00; F21S 10/002; F21S 10/02; F21S 10/06

USPC ..... 362/96, 458, 101, 231, 23, 154, 155, 362/184; 4/231, 661, 234

See application file for complete search history.

(56) References Cited

U.S. PATENT DOCUMENTS

| | | | | |
|---|---|---|---|---|
| 5,003,648 | A * | 4/1991 | Anderson | 4/661 |
| 5,263,209 | A | 11/1993 | Pattee | |
| 5,276,595 | A * | 1/1994 | Patrie | 362/101 |

(Continued)

FOREIGN PATENT DOCUMENTS

| | | |
|---|---|---|
| CN | 201010510545.9 | 5/2012 |
| CN | 201120523013.9 | 10/2012 |
| DE | 102010025866 | 1/2012 |

*Primary Examiner* — Anh Mai
*Assistant Examiner* — Arman B Fallahkhair

(57) ABSTRACT

A toilet lighting system and method is disclosed. The lighting system can include a light source directed into a toilet waste container to seek to provide a predetermined lighting effect. One such effect can be to obscure or mask the appearance of waste in the toilet waste container, which, depending on the particular system, can render the user experience less unappealing and even entertaining, more efficient, and/or less wasteful or messy. The light source can be predetermined and mounted to provide various types of effects when material in the toilet waste container is exposed to the light from the light source. The toilet lighting system can be waterproof and capable of being exposed to high fluid pressure when pressure washed. The toilet lighting system can be powered in a number of ways, including by battery, solar, wind, geothermal, or other power supplying systems. Power supplying systems can be switched on and off in any number of ways, including by providing a strobing or intermittent lighting effect. The system can be provided in fixed or portable toilets.

20 Claims, 7 Drawing Sheets

(56) References Cited

U.S. PATENT DOCUMENTS

| | | | | |
|---|---|---|---|---|
| 6,279,180 | B1 | 8/2001 | Bell et al. | |
| 6,488,393 | B1 | 12/2002 | Burnham | |
| 6,827,464 | B2 | 12/2004 | Koren et al. | |
| 7,652,436 | B2 | 1/2010 | Dowling et al. | |
| 7,731,396 | B2 | 6/2010 | Fay et al. | |
| 7,821,212 | B2 | 10/2010 | Wray | |
| 7,854,528 | B2 | 12/2010 | Segretto et al. | |
| 8,359,676 | B2 * | 1/2013 | Richard et al. | 4/223 |
| 2003/0057884 | A1 * | 3/2003 | Dowling et al. | 315/291 |
| 2004/0004827 | A1 | 1/2004 | Guest | |
| 2005/0063194 | A1 * | 3/2005 | Lys et al. | 362/545 |
| 2008/0028505 | A1 * | 2/2008 | Penn | 4/231 |
| 2012/0000015 | A1 | 1/2012 | Mcclendon et al. | |
| 2012/0023651 | A1 * | 2/2012 | Taylor et al. | 4/234 |

* cited by examiner

SYSTEM AND METHOD FOR LIGHTING TOILET WASTE AREA

CROSS-REFERENCE TO RELATED APPLICATIONS

The present application claims priority through the applicant's prior provisional patent application, entitled "A METHOD AND SYSTEM FOR GENERATING AND PROJECTING LIGHT IN VARIANT COLORS AND STRUCTURAL PATTERNS," Ser. No. 61/598,479, filed Feb. 14, 2012, which provisional patent application is hereby incorporated by reference in its entirety.

FIELD OF INVENTION

The technology of the present application relates to a waste storage area light projection system and method, and more particularly to a system and method for the projection of light within a toilet or toilet waste contact or storage area.

BACKGROUND

The use of bathroom facilities is not something that people have traditionally associated with notions of pleasantness. Event organizers, national parks, and all manner of businesses have long been concerned with the experience of using bathroom facilities, both with respect to sanitation as well as to the aesthetics of using such facilities. Luxury amenities include such features as hands-free pedal and automatic flushing toilets, hot and cold running water, hand-washing stations, appealing laminate walls, fashionable counter tops, decorative ambient lighting, skylights, music, and porcelain sinks and toilet fixtures.

Many of today's restroom facilities—particularly but not only portable facilities—utilize a catch basin or internal holding tank for the accumulation, storage, and later removal of waste. This is in contrast to facilities integrated into a sewer system to remove waste from the visual area of the toilet. The accumulation of waste matter in these catch basins and storage tanks creates an unpleasant visual experience for the users of these facilities, and results in an overall negative mental image that can impact the image of the event or business providing the facility. Currently existing products and solutions fail to fully address the negative visual experience that results from observing the accumulation of waste within the catch basin or toilet basin. While addressing the overall sensory experience of a bathroom visit is of value, the unpleasant visuals that occur upon approaching the toilet itself can negate this initial positive impression.

The classic method for removing this negative visual experience has been the use of a hinged toilet seat lid. While a lid that covers the opening to the catch basin or storage container can help reduce the initial negative visual experience, it is dependent on other users of the facility lowering the lid after use. A further disadvantage is that prior to using the toilet, the lid must be raised, making the negative visual experience nearly unavoidable.

Similarly, the use of decorative or luxury materials to construct the toilet itself does not detract from the negative visuals relating to the accumulation of waste. One disadvantage to decorative lids is that they draw attention to the lid, which then leads to a the user of the facility being immediately directed to a view of the waste product in the catch basin or storage container upon lifting the lid.

A further disadvantage is that a lid will, at best, reduce the extent of the negative mental impression. The lid itself typically neither enhances the experience of using the facility, nor serves as a differentiator for purposes of marketing the quality of a facility or the experience associated with the person(s) or organization(s) providing, or associated with, the facility.

Another prior art solution has been to include colored water in the storage tank below the toilet seat. This solution only work when the amount of solution sufficiently deeply covers the waste in the tank. This is quite often not the case, particularly as the facility is used to a substantial degree. Further, this solution does not work for waste that floats, which waste often does.

Yet another prior art solution has been to provide a flapper valve at the lower end of the toilet in order to block the waste from view. Flapper valves, however, result in a variety of problems including that they quickly become dirty, can block waste flow to the storage tank, and cause upward splashing of waste toward or even above the toilet seat lid and to the side of lower waste passage covered by the flapper valve.

Water flush systems have also been employed to flush waste away from view. Water flush systems are inherently more complex and costly. Frequently, resources are not available to support such systems. They are therefore frequently not utilized despite their utility.

BRIEF SUMMARY OF SOME ASPECTS OF THE DISCLOSURE

The present system and method utilizes light in the catch basin or waste storage tank in a toilet or other waste processing or storage facility. In some embodiments, an obscuring or masking effect can result from directing light within the toilet or waste storage tank.

In some systems, am obscuring effect occurs or is enhanced when the light is directed at waste or other material, such as a waste treatment liquid for example, in the toilet or waste storage container. In certain systems, an obscuring or masking effect can be provided or enhanced by providing light reflective, diffusing, generating, and/or scattering aerosolized particulates or gas in the toilet or waste storage container.

In some embodiments for example, a masking effect can be produced by including particulates mixed with water or other material in the catch basin or storage tank. These particulates can increase the color, light intensity, scattering, diffusing, or reflective qualities of the resulting fluid, waste, and/or one or more of their components in the toilet, catch basin, or storage tank.

In certain embodiments, the light provided can vary in intensity and color with wavelengths from about 390 nm to 750 nm and a frequency band in the vicinity of 400 THz to 790 THz. Some applications provide one or more predetermined light wavelengths or wavelength ranges, or colors, based upon the colors produced when the predetermined light is directed at matter within the toilet or storage tank. In some embodiments, that matter can be all or one or more portions of toilet or storage tank walls, storage tank fluid, waste containable in the tank, or other material in the toilet or tank.

In some embodiments, an interference medium is introduced between one ore more light sources. The interference medium can include different types of optics providing differing types of translucence, interference, coherence, diffusion, or focusing of light emitted by the optics. The patterns produced as a result of the light passing through the optics can be further altered based upon the color and intensity of the light, as well as by variations the supply of power or by disrupting power, such with a predetermine strobing effect for example. In this application, the term "strobing" means predetermined patterns of a turning a light source on an off and which may or may not be regular and may include an on or off period longer than a short duration flash of light.

In certain applications, these patterns can be purely decorative or can convey specific information such as identifiable words or pictures. Similarly, optics or light sources can be customized to project specific patterns, words, colors or images associated with specific products, services, events, or themes, further adding to the positive experience of the user of the facility.

In some embodiments, one or light emitting diodes provide light within a toilet or waste storage container. In certain embodiments, lasers are utilized.

Some systems provide a plurality of light emitting diodes mounted within a toilet or waste storage tank and aimed to direct light toward the surface of the waste and/or fluid in the waste storage tank. Certain instances include light diffusing structure, such as a lens in one type of system, to scatter or redirect light from the light source throughout, or to portions of, a catch basin or waste storage area.

Other types of light sources may be utilized, such as, for example, fluorescent, ultra-violet, infra-red, or other types of sources. Similarly, materials that provide desired obscuring or diffusing effects in cooperation with the type of light provided, can be utilized within the catch basin or waste storage area.

In some embodiments, the light source is activated by a toggle or other switch. For example, this switch may be a mechanical or magnetic switch toggled on by the opening and closing of bathroom door or the opening and closing of the lid covering a waste catch basin or storage area. Alternatively, the switch could be a motion- or sound-sensitive device that activates the light for a predetermined set of time based upon the last detected motion or sound, as applicable, within a given area. This switch may further trigger the release of an additive or particulate in the catch basin or storage container enhancing the degree and character of the light reflected.

In some embodiments, the apparatus is powered by a battery system or by the combination of a solar panel system and a battery system. Alternatively or in combination, the apparatus can be powered by standard residential or other power line with appropriate voltage conversion and regulating circuitry when needed.

Some embodiments can provide a lightweight plastic light housing with one or more light sources, optics, or lenses mounted in the housing. The housing can including mounting structure for mounting the housing to the bottom side of a toilet seat or other structure above or adjacent a waste holding area.

The housing may include one or more batteries for powering the light source(s). Alternatively or in addition, the housing may include wiring for connection to a power source external of the housing, such as to a battery pack or other power source outside the interior of a catch basin or waste holding area.

Some embodiments can provide an economical, easily manufactured, and easily cleaned and maintained light source for providing obscuring, diffusing, obscuring, or otherwise aesthetically enhancing light within a toilet catch basin or toilet was area. Certain systems can be easily manufactured as part of a new toilet or portable toilet or toilet waste storage system or retrofitted to existing toilets, portable toilets, or fixed or portable toilet waste storage systems. Certain systems can be waterproof, including to the degree of not leaking when pressure washed such as during pressure washing of a portable toilet.

The systems disclosed herein can be arranged to provide light with the toilet and/or area of the toilet so that users are also more comfortable and less likely to spoil adjacent areas or materials such as toilet paper for example.

It is to be understood that this Brief Summary recites some aspects of the present disclosure, but there are other novel and advantageous aspects disclosed in this specification. They will become apparent as this specification proceeds. In this regard, the scope of the invention is to be determined by the claims as issued and not by whether a claim addresses any or all issues noted in the Background or includes a feature included or not included in this Brief Summary.

BRIEF DESCRIPTION OF THE DRAWINGS

The applicant's preferred and other embodiments are disclosed in the accompanying drawings in which.

DETAILED DESCRIPTION OF THE PREFERRED AND OTHER EMBODIMENTS

Figure 1:
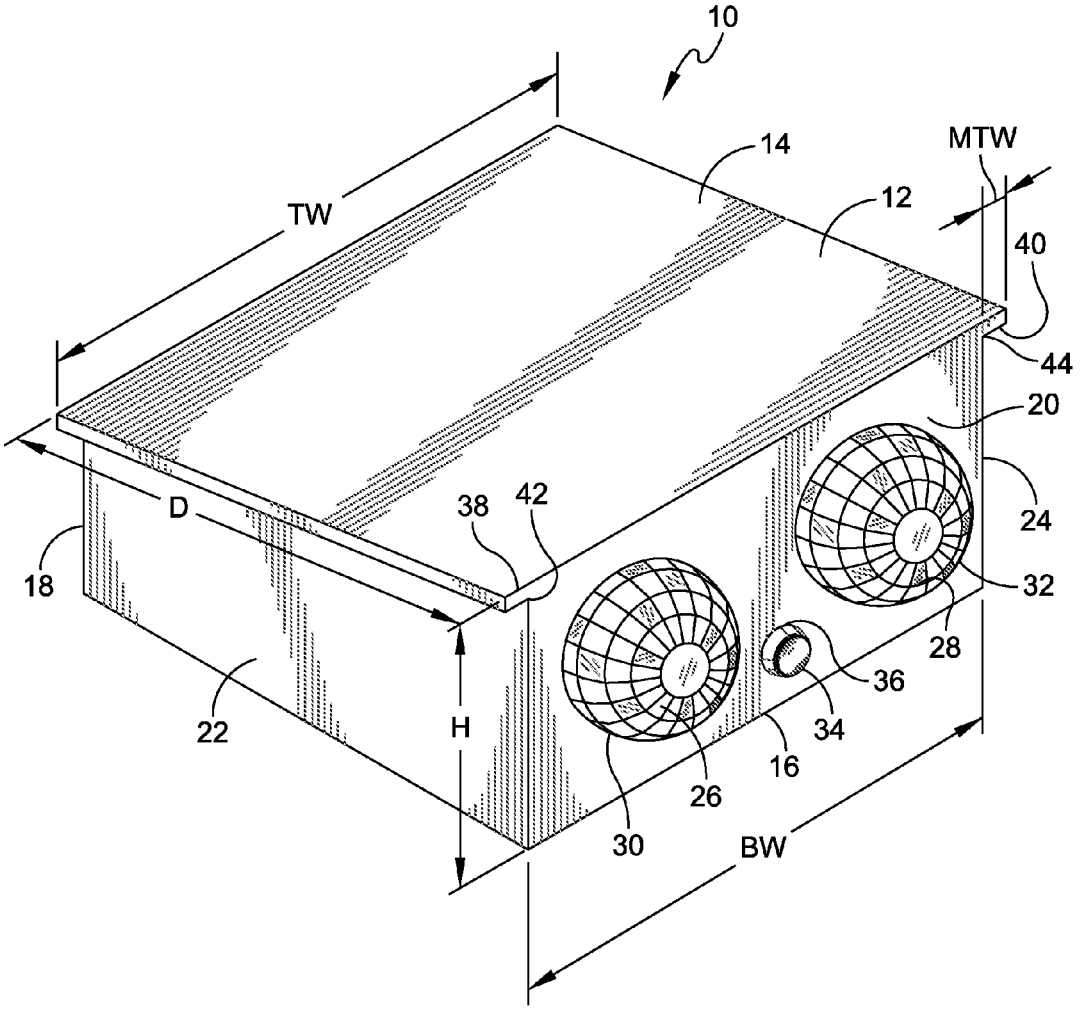
FIG. 1 is a perspective of a two lens embodiment for mounting to the bottom of a toilet seat surface above a toilet waste storage area.

With reference to FIG. 1, one embodiment of the lighting system, generally 10, has a plastic housing 12 with a planar top side 14, a planar bottom side 16, a planar top side 14 at an acute angle to the plane of the planar top side 16, a planar back side or access panel 18 coplanar with a planar front side 20, and two opposing coplanar lateral sides 22, 24. The back side 18, front side 20, and opposing lateral sides 22, 24 extend between, and perpendicularly from, the top side 14 and bottom side 16 of the housing 12. Two laterally spaced light diffusing but also focusing dome lenses 26, 28 project outwardly from the front side 20 through mating laterally spaced lens passages 30, 32, respectively, penetrating the front, lighting side 18 of the plastic housing 12. In this embodiment, a lighting on-off button 34 projects outwardly from the front side 20 through a mating button passage 36 penetrating the front side 20 of the housing 12.

The top side 14 is wider than the bottom side 16, providing two laterally opposed planar mounting tabs 38, 40. The first mounting tab 38 extends perpendicularly outwardly from the sloped upper edge 42 of one of the lateral sides 22 of the housing 12, and the second mounting tab 40 extends perpendicularly from the sloped upper edge 44 of the second lateral side 24.

In one embodiment of this type of lighting system, generally 10, the bottom width BW is 6.5 inches, the top width TW is 7.5 inches, the top side depth D is 6.08 inches, and the front side height H is 3.5 inches. Each mounting tab width, e.g., MTW, is 0.5 inches. When fully assembled, this lighting system, generally 10, is completely self contained, water proof, and weighs approximately 1.5 lbs.

Figure 2:
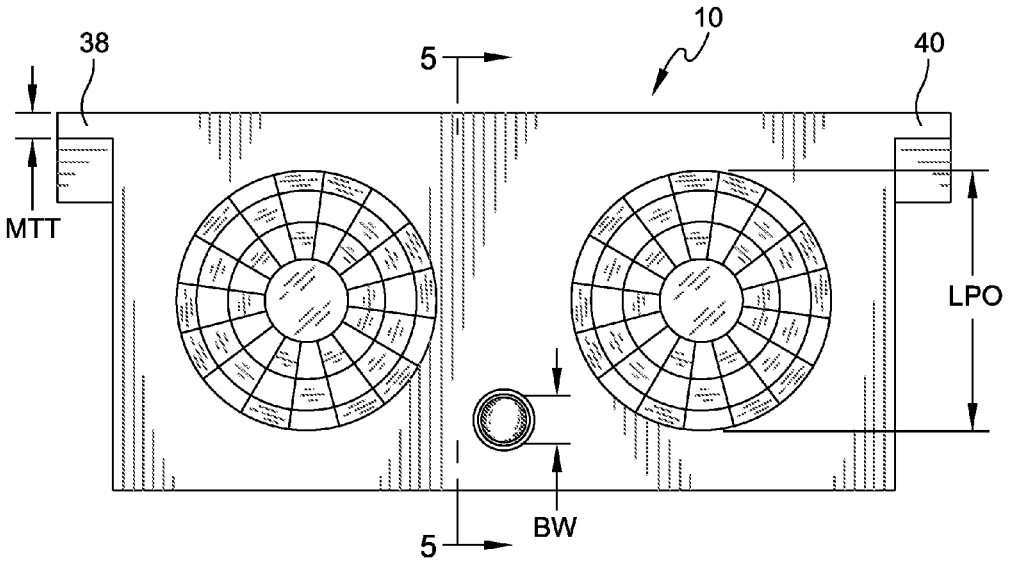
FIG. 2 is a front elevational view of the two lens embodiment of FIG. 1.

With reference now to FIG. 2, the lens passage opening LPO is 2 inches while the lens width (within the housing) is 2.25 inches. The on-off button width BW is 0.5 inches. Each mounting tab thickness, e.g., MTT, is 0.25 inches.

Figure 3:
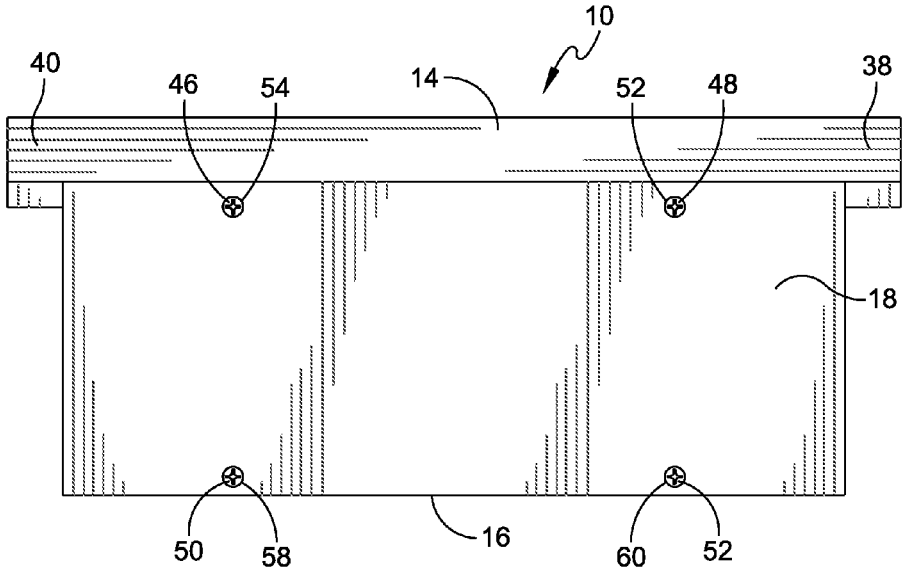
FIG. 3 is a rear elevational view of the two lens embodiment of FIG. 1.

With reference to FIG. 3, the back side 16 of the housing 12 has a rectangular outer periphery and is removable from the remainder of the housing 12 in order to provide access to the interior (not shown in FIG. 3) of the housing, generally 10. The back side 16 also has four stainless steel screw fasteners, 46, 48, 50, 52, penetrating mating screw fastener passages, 54, 56, 58, 60, respectively, in order to removably secure the back side 16 in place with respect to the remainder of the housing 12.

Figure 4:
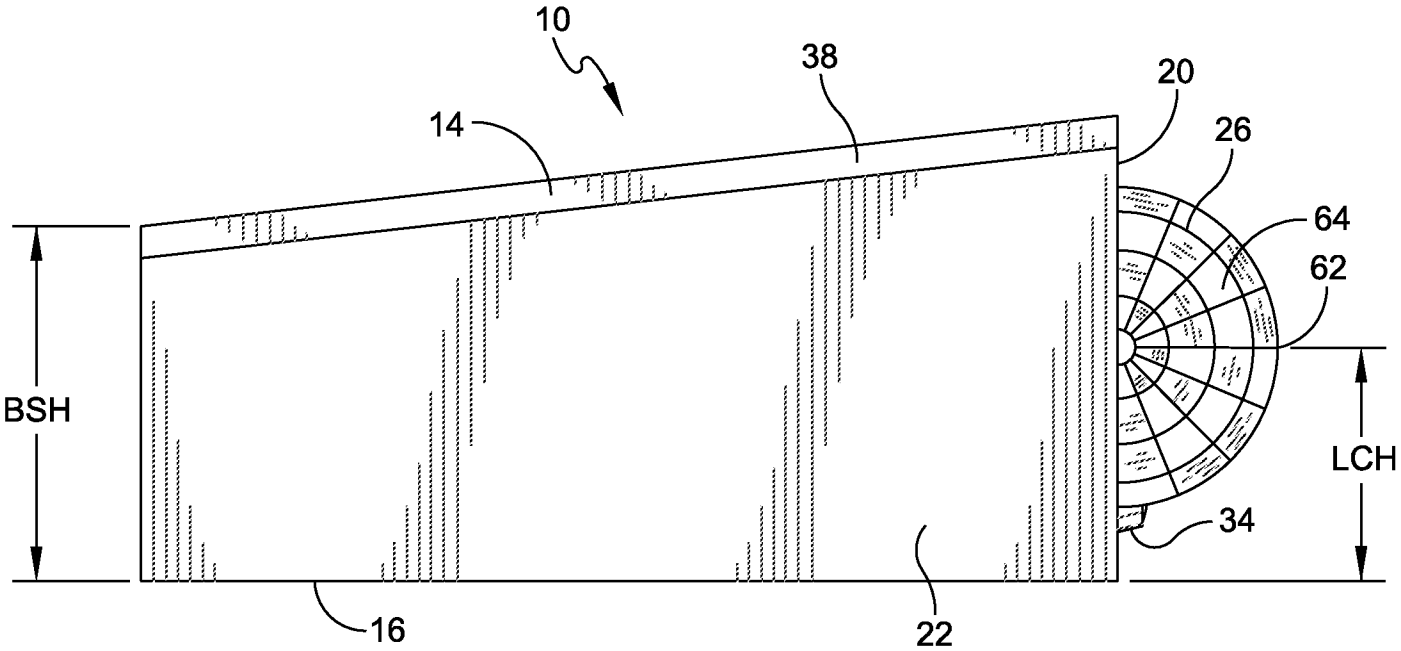
FIG. 4 is a first side elevational view of the two lens embodiment of FIG. 1 but with a slightly differently shaped lens.

Referring now to FIG. 4, each of the planar lateral sides, e.g., 22, has a back side height BSD of 2.5 inches. Each dome lens, e.g., 26, has a center 62 mounted 1.25 inches perpendicularly upwardly from the plane of the planar bottom side 16 of the housing, generally 10. The dome lens 26 includes a hemispherical lens section 64 extending outwardly from the planar front side 20 of the housing 12.

Figure 5:
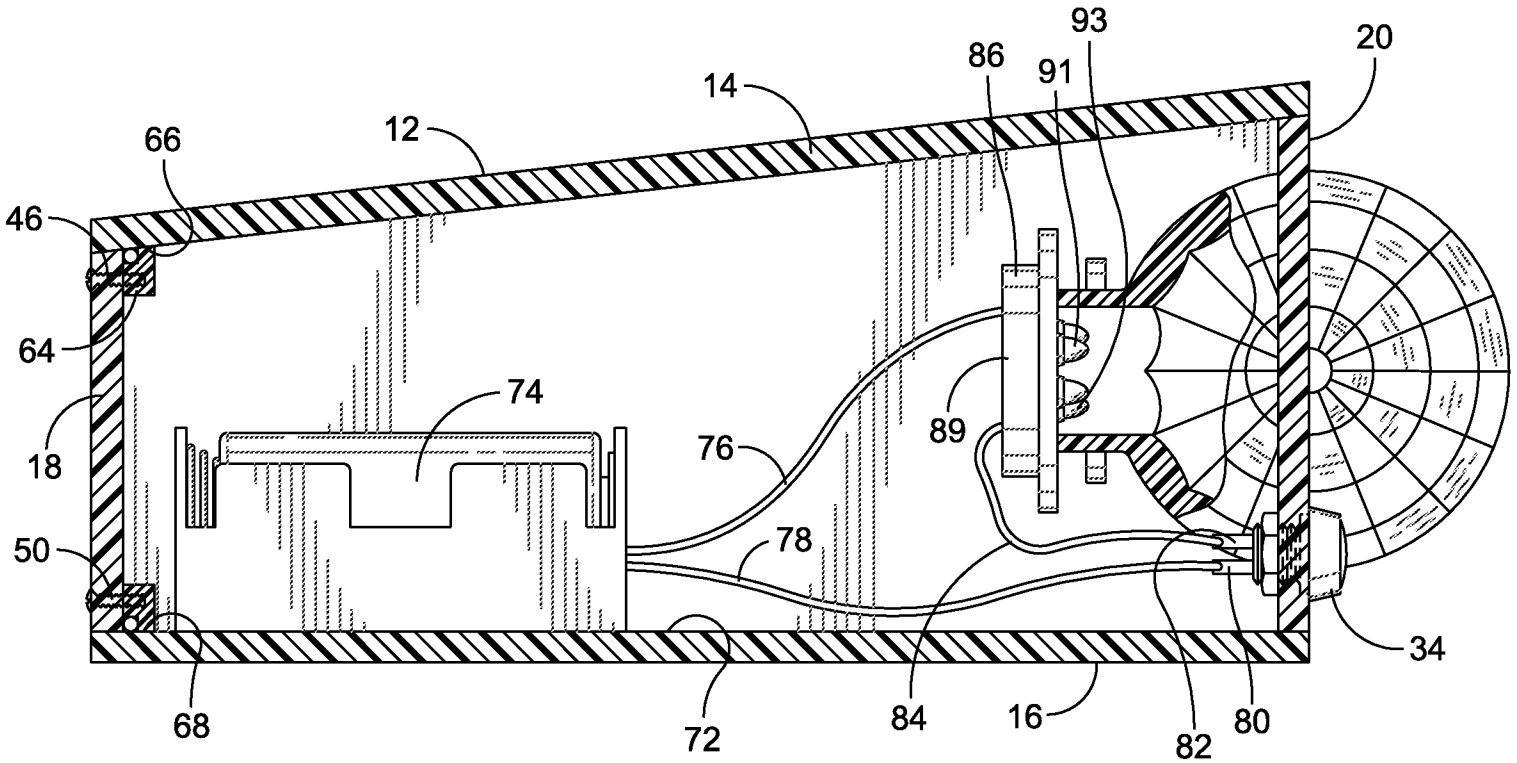
FIG. 5 is a cross-sectional view of the two lens embodiment taken along section line 5-5 of FIG. 2 but with a slightly differently shaped lens.

With reference now to FIG. 5, the housing top side 14, bottom side 16, back side 18, and front side 20 are all made of 0.25 inch thick acrylic or polyethylene. A rectangular seal mount 64, having a foam rubber rear side seal mounted within a mating rectangular groove in the rear or the seal mount 64, is glued to, and abuts, the four rear interior sides, e.g., 66, 68, of the housing 12. The four stainless screws, e.g., 46, 50, penetrate the seal mount 64 in order to securely mount the back side 18 in position with respect to housing 12. Additional sealing structure, such as foam rubber and/or silicone sealant, can be applied at the junction of the various side walls, and/or at the junction a side wall passage with the light lens and light switch, as needed, if needed, to render the resulting lighting assembly more waterproof and, if desired, impermeable to washing fluid directed at the lighting assembly under high pressure.

A generally box-shaped battery pack 70 is mounted by fasteners or glue (not shown) to the interior upper planar surface 72 of bottom side 16 closest to the back side 18 of the housing 12. Three D-cell batteries 74 are mounted within the battery pack 70 to yield 4.5 volts via positive and negative electrical power supplying wires 76, 78, respectively, extending from power supplying lateral end 80 of the battery pack 70 toward the front side 20 of the housing 12. The positive power supply line 76 extends from the battery pack 70 to connect to a first terminal on the pushbutton on/off switch 34, and a switched power supply line 84 connects to the power supply end 86 of a surface or top mount lamp 88. The negative power supply line 78 similarly connects to the power supply end 86 of the lamp 88.

The lamp 88 has a circular printed circuit board 89 with an integrated chip (not shown) mounted on the board to supply power to four LEDs, e.g, 91, 93, mounted around the circular periphery of the PCB board. A lens from a Prismatic Globe Wand surrounds the LEDs to distribute light generated by the LEDs outwardly through the lens. The printed circuit board 89 provides predetermined strobing of the LEDs and is an off the shelf item. Its method of manufacture and use is well known to those of skill in the art.

One exemplary lamp LED 93 is provided by an Avago Technologies Power PLCC-4 SMT LED with Lens, which is a top mount single chip package with focused radiation (providing a narrow viewing angle of 50°) and high brightness in the beam direction. Depending on the model selected, this type of LED can provide one of any of three types of amber, two types of red, orange, red orange light, green, or blue light. At an ambient temperature of 25° C.:

1. the amber LEDs have a peak wavelength of 592 nm, a dominant wavelength of 590 nm, a viewing angle of 50 degrees, luminous efficacy of 480 Im/W, and luminous efficiency of 22 Im/W;

2. the red lamps LEDs a peak wavelength of 635 nm, a dominant wavelength of 626 nm, a viewing angle of 50 degrees, luminous efficacy of 150 Im/W, and luminous efficiency of 19 Im/W;

3. the orange LED has a peak wavelength of 609 nm, a dominant wavelength of 605 nm, a viewing angle of 50 degrees, luminous efficacy of 320 Im/W, and luminous efficiency of 23 Im/W;

4. red orange LED has a peak wavelength of 621 nm, a dominant wavelength of 615 nm, a viewing angle of 50 degrees, luminous efficacy of 240 Im/W, and luminous efficiency of 14 Im/W;

5. the green LED has a peak wavelength of 518 nm, a dominant wavelength of 525 nm, a viewing angle of 50 degrees, luminous efficacy of 500 Im/W, and luminous efficiency of 10 Im/W; and 6. the blue lamp LED peak wavelength of 468 nm, a dominant wavelength of 470 nm, a viewing angle of 50 degrees, luminous efficacy of 75 Im/W, and luminous efficiency of 7 Im/W.

An alternative LED 93 utilizes an Avago Technologies ASMT-FG10-NFJOO dome lamp. This LED 93 includes an untinted, nondiffused lens to provide a high luminous intensity with a narrow radiation pattern. This LED 93 includes an encapsulated LED chip on an axial lead frame within a molded epoxy lamp package. The color provide by this lamp is green, and at an ambient temperature of 25° C., provides a peak wavelength of 525 nm, a dominant wavelength of 530 nm, a viewing angle of 11 degrees, luminous efficacy of 535 Im/W, and luminous efficiency of 32 Im/W.

The pushbutton on-off switch 34 can be a waterproof V12-B Zinc Alloy pushbutton switch. The battery pack 70 can be a Model BH131 Blossom Brand pack, having three D batteries mounted within the pack. For applications requiring differing voltage, differing battery life, or differing battery form factor, differing batteries and battery mounts may be utilized.

Figure 6:
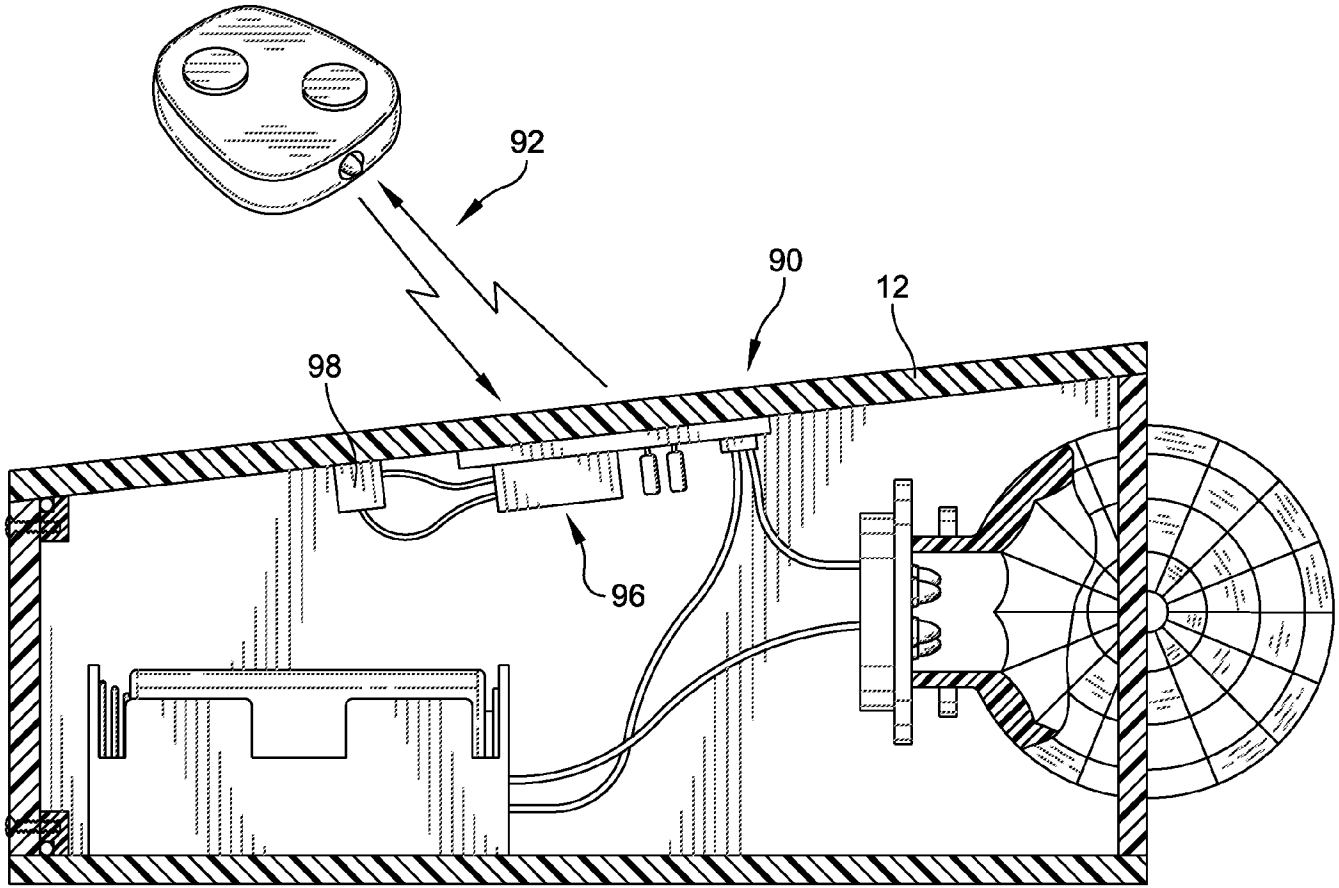
FIG. 6 is a alternative cross-sectional view of the two lens embodiment, taken along section 5-5 of FIG. 2 (but with a slightly differently shaped lens), including a remote controlled light switch in the light housing and a remote light control external to the housing.

With reference now to FIG. 6, an alternative embodiment of the light assembly, generally 90, substitutes a wireless on-off switching system, generally 92, for a pushbutton on/of switch (not shown in FIG. 6). The wireless switching system, generally 92, includes a remote wireless switch 94 and an internal wireless pc board mounted switching circuitry, generally 96. In this embodiment, the wireless pc board, generally 96, is mounted, with fasteners or glue (not shown), to the upper interior surface 98 of the upper side 14 of the housing 12. A conventional 12 volt battery 98 provides power to the wireless pc board, generally 96, and is also mounted in a battery mount fastened or glued to the upper interior surface 98 of the housing 12. An exemplary such wireless system, generally 12, is the Zbara 12DC Wireless Remote Control Switch Security System, Model YU-02A+036F-02.

Figure 7:
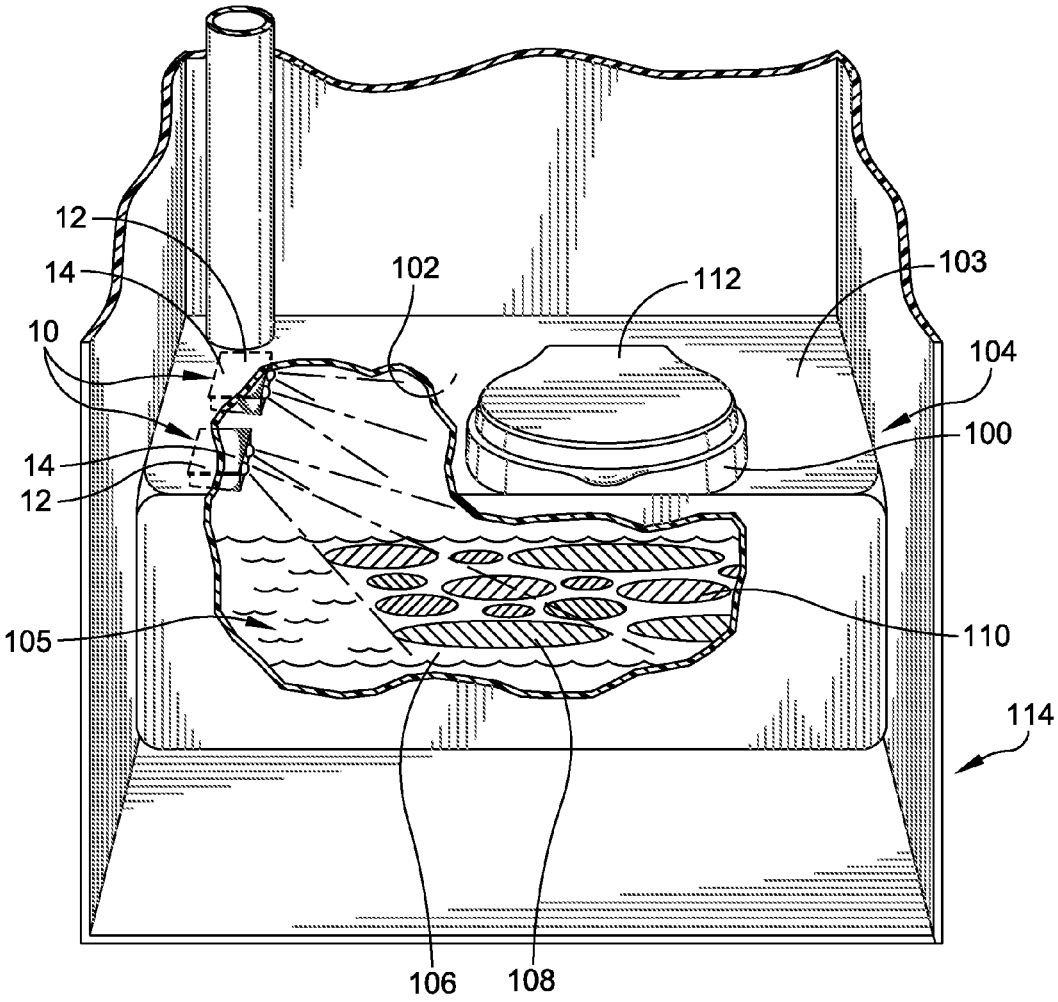
FIG. 7 is a perspective view of the two lens light housing of FIG. 1 mounted to the bottom side of toilet seat surface above a waste storage area in a portable toilet, with a breakaway section showing the lights in the light housing directing light across the upper surface of waste and fluid in the waste storage area.

With reference now to FIG. 7, in one application, two light assemblies, generally 10, are mounted to direct light below the surface of toilet seat, 100. In this particular embodiment, the upper side 16 of each light assembly housing 12 is securely glued or fastened by fasteners (not shown) to the underside 102 of a toilet seat support table 103, which is, in this particular embodiment, the top side 103 of a portable waste container, generally 104. The portable waste container 104 could instead be a fixed location waste container.

Exemplary such fasteners (not shown) are stainless steel fasteners (not shown) penetrating through, as shown in FIG. 1, the opposing mounting tabs 38, 40, into, as shown in FIG. 7, the toilet seat support table 103. In this fashion, the passages for these fasteners do not penetrate the interior of a light assembly 100, so the light assembly 100 can, for example, be safely and securely pressure washed along with other structure in the waste storage container and without the wash leading into the interior of the light assembly 100.

Exemplary such glue (not shown) is epoxy (which also may be used to glue components as described elsewhere in this specification), such as two-part Bondit B45TH epoxy. This latter type of epoxy is flexible, resists extreme temperatures, begin to cure within 30-40 minutes, and will bond to many plastics, such as polyethylene. Other epoxies may be utilized if quicker curing time or other properties are desired.

With reference back to FIG. 4, because of the acute angle of top planar side with respect to the bottom planar side 16, when the light assemblies 10 are mounted to the planar mating underside 102 of the support table 103, the light emitted from the assemblies is directed toward waste, generally 105, in the waste storage container, generally 104 at an acute angle to the plane of the underside 102 of the support table 103. In the depicted embodiment of FIG. 7, light can thus be used to illuminate waste, fluid, or other material, e.g., 106, 108, 110, within the waste container, generally 104, and create colors or diffused images that do not look like waste and can be much more appealing to observe. At the same time, the light provided by one or more light assemblies 100 can help illuminate the area surrounding the toilet area when the toilet seat 112 is lifted in particular.

Figure 8:
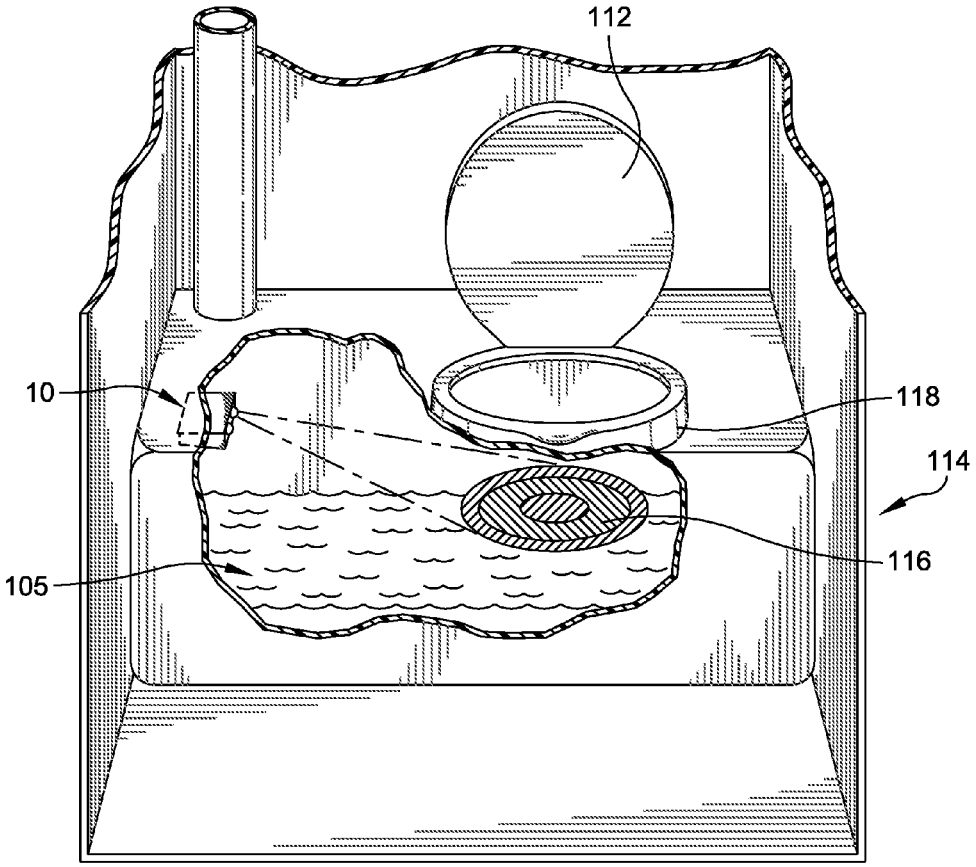
FIG. 8 is a perspective view of a toilet and toilet storage tank apparatus having a light assembly providing a light target or other image on the upper surface of the fluid or waste material in the toilet storage tank.

As shown in FIG. 8, with one or more light assemblies 100 included in the toilet apparatus, generally 114, it can be beneficial to include a light assembly (not shown) that projects light to form a predetermined light target 116 on the surface of the waste, generally 105, vertically below, for example, the radial center of the toilet seat 118. This target 116 can provide an illuminated aiming target for males, particularly but not only young boys, when they are standing and urinating into the waste storage container 114 through the opening otherwise covered by the toilet seat lid 112. Of course, the light source can be located in other locations as desired or needed to form the desired light exposure and image with the waste container 114.

In another embodiment (not shown), four light sources are positioned on the underside of the toilet basin at the furthest most point from the toilet waste passage into the toilet basin immediately below the toilet seat. Blue dye is deposited in water in the basin as is human feces, urine, and toilet paper. The light sources each include 5 mm round green and red LEDs mounted to provide light through lens such as the Prismatic lens identified above.

The red LED lights have a forward voltage of 2-2.2 volts, a viewing angle of 15-20 degrees, a current of 20 mA, a luminous intensity of 15,000 mcd, and a color wavelength of 619-622 nm. Exemplary such LEDs are model HQ-5B25-4 from Joe Knows Electronics, LLC, Greer, S.C.

The green LED lights have a forward voltage of 3-3.2 volts, a viewing angle of 15-20 degrees, a current of 20 mA, a luminous intensity of 25,000 mcd, and a color wavelength of 515-530 nm. Exemplary such LEDs are model HQ-5B25-7 from Joe Knows Electronics, LLC.

The green and red LED power supplying circuitry is configured to repeatedly flash on and off at a rate of about 3 seconds in the on state followed by about 0.25 seconds in the off state. This configuration produces round light patterns consisting of about 0.5-inch to about 4.0-inch diameter circles and elliptical shapes projecting onto the waste material.

As a result, the waste in the waste container becomes virtually indiscernible as feces, urine, or toilet paper without substantial effort on the part of the observer. Borders of objects become obscured, and the resulting colors of the waste are different than under ordinary light. The flashing creates visual distraction and inability to focus on objects, further reduces an observer's ability to discern waste material in the waste area.

In yet another embodiment (not shown), four light sources are positioned on the underside of the toilet basin at the furthest most point from the toilet waste passage into the basin immediately below the toilet seat. A dry toilet basin with waste includes fecal matter, urine, and toilet paper.

The light sources each include 5 mm round blue led lights with a forward voltage 3-3.2 volts, current of 30 mA, luminous intensity of 10,000 mcd, and a color wavelength of 465-468 nm. The viewing angle is between 15-20 degrees (although viewing angles of from 10 to 25 degrees can also be effective and efficient). Exemplary such LEDS are blue LED's model HQ-5B25-5 from Joe Knows Electronics, LLC.

The LED power supplying circuitry is configured to repeatedly flash on and off at a rate of about 3 seconds in the on state followed by about 0.25 seconds in the off state. This configuration produces round light patterns consisting of about 0.5-inch to about 4.0-inch diameter circles and elliptical shapes projecting onto the waste material, and the reflected light makes it difficult to discern the nature of the waste material. The light flashing also creates a visual distraction and inability to focus on waste components, further reducing an observer's ability to discern the nature of the waste material.

It is to be understood that FIGS. 7 and 8 depict only one of many toilet structures that may be provided light in order to illuminate some or all of a waste catch basin or waste storage area. Further, the depicted light assemblies are only of many ways of providing light within a toilet catch basin or waste storage area. For example:

(i) the batteries can be mounted external of the lighting structure and, if desired, made accessible from outside of the waste storage container, and differing batteries may be utilized as need to provide the needed voltage for the lighting source(s);

(ii) other types power sources may be utilized along with any needed voltage conversion or treating circuitry well known in the art, and the battery system (such as a rechargeable battery system) and other power supply system can be augmented by a solar, wind, geothermal or other power supply mounted on, in the vicinity of, or otherwise providing power to the toilet housing structure;

(iii) the light housing structure may be (a) integrally molded within toilet structure, such as a portion of a catch basin or waste storage area; or (b) molded such as by blow molding of, for example, the top, front, and lateral sides as a one piece structure;

(iv) a light assembly may be mounted to desired structure in many other ways, such as by Velcro, double-sided tape, or any suitable fastener(s) or adhesive(s);

(v) other light switching may be utilized, such as a sound activated switch, a wall switch, or toilet door activated switch that turns on the light provided by a light assembly upon opening of the toilet door;

(vi) one or more light assemblies may provide any of a variety of predetermined or random images or themes;

(vii) a light assembly may include one or more lasers or other lights, which can, for example, be aimed at a variety of locations to further distract from looking at the waste, create a variety of images, etc.;

(viii) airborne materials (such as gas) and other particulates or materials may be added to the storage container, or fluid in the container, to create various visual effects in response to exposure to light either provided systems and methods such as disclosed herein and/or by natural or other ambient light;

(ix) various differing lights and other features, such as noted in the Brief Summary above, may be utilized to provide obscuring, masking, distracting, or other desired lighting effects; and differing material(s) may be utilized in the catch basin or storage container to provide the desired effect based on the light utilized, including ambient light; and (x) the light housing may be constructed in any number of ways depending on the circumstances; for example, the light housing can include additional laterally extending mounting tabs on the bottom side rather than, or in addition to, the top side (as described above). In such an event, the light assembly can be flipped upside down and mounted to the underside of a structure via the additional mounting tabs (rather than the top side mounting tabs) to provide a different angle of, or parallel, light direction with respect to such underside. The housing can be light in weight; and for certain applications, such as for portable toilets as an example, the weight of the entire lighting assembly will weigh 0.2 to 6 lbs.

As one example, if one or more portions of the housing are formed of other toilet structure (such as one more waste container walls), the weight can be reduced substantially. One embodiment can utilize the side wall of a waste storage container as a back or rear wall for the light assembly and the top wall of the storage container as the top for the light assembly. Sealing structure can be included as necessary. One or more portions of resulting light assembly top or rear wall (provided by the storage container) can be removable and held in place by fasteners, such as stainless steel fasteners for example, in order to provide access into the interior of the lighting assembly. This type of assembly can also make system maintenance much easier, less messy, and less labor intensive.

In addition or in the alternative, the battery (or other power source) can be external to the lighting assembly and to the interior of the waste storage container. For example, the power supply wires could penetrate a passage drilled or otherwise formed in the lighting assembly back or top wall to connect to the battery or other power supply structure external to the waste storage container interior. The wire passage can be sealed in any number of ways, including by use of epoxy, silicone sealant, and/or or other mechanical structure. This type of power delivery structure can make battery replacement easier, less messy, and less time consuming The power on-off switch could be similarly arranged to be external to the waste container interior. The user of the facility could thus turn the light source on and off as desired, or the switch can be otherwise wired to other switching structure as explained above.

The foregoing is a detailed description of some embodiments and aspects of this specification and is not intended to be limiting. Many other embodiments are possible and within the skill of those in the art.

I claim:

1. A toilet lighting apparatus comprising in combination: a toilet having a toilet waste passage in waste-passage communication with a waste storage container surrounding a waste storage area; a predetermined light source assembly mounted within the waste storage container, the predetermined light source assembly having a front surface and at least two predetermined light sources positioned on the front surface, the at least two predetermined light sources in power-supply communication with a power source; an inner lens enclosing the at least two predetermined light sources on the front surface; and an outer lens positioned proximate the inner lens on a same spherical surface; whereby the light source assembly directs light from the predetermined light sources through the inner lens and outer lens into the waste storage area, wherein each of the at least two predetermined light sources produces a predetermined light pattern, based on material in the waste storage area and flashed at predetermined time intervals, designed to obscure visibility of material in the waste storage area.

2. The toilet lighting apparatus of claim 1 wherein (i) the waste storage container has a waste storage area and (ii) the predetermined light source is aimed at the waste storage area.

3. The toilet lighting apparatus of claim 2 wherein the waste storage container includes a predetermined non-waste additive material in the waste storage area, whereby the predetermined non-waste additive material can intermix with waste deposited into the waste storage area in the waste storage container.

4. The toilet lighting apparatus of claim 3 wherein the predetermined non-waste additive material is a blue dye.

5. The toilet lighting apparatus of claim 2 wherein each of the at least two predetermined light sources comprise a light emitting diode.

6. The toilet lighting apparatus of claim 5 wherein the light emitting diode has a 15-20 degree viewing angle lens.

7. The toilet lighting apparatus of claim 1 wherein the waste storage container includes a predetermined non-waste additive material in the waste storage area, whereby the predetermined non-waste additive material can intermix with waste deposited into the waste storage area in the waste storage container.

8. The toilet lighting apparatus of claim 7 wherein the predetermined non-waste additive material is a blue dye.

9. The toilet lighting apparatus of claim 7 wherein the power source includes a light strobing circuit.

10. The toilet lighting apparatus of claim 1 wherein each of the at least two predetermined light sources comprise a light emitting diode.

11. The toilet lighting apparatus of claim 10 wherein the light emitting diode has a 15-20 degree viewing angle lens.

12. The toilet lighting apparatus of claim 1 wherein the power source includes a light strobing circuit.

13. The toilet lighting apparatus of claim 12 wherein the light strobing circuit is configured to flash the at least two predetermined light sources at predetermined time intervals, and wherein an on state for each of the at least two predetermined light sources is longer than an off state for each of the at least two predetermined light sources.

14. The toilet lighting apparatus of claim 1 wherein the predetermined light sources are in wireless communication with a switch.

15. A method of lighting a toilet waste area, comprising:

A. selecting at least two light sources for a toilet waste container area in a toilet waste container below a toilet passage, the at least two light sources housed in a single housing;

B. installing the housing within the toilet waste container; and

C. flashing the at least two light sources through an inner lens and an outer lens in a predetermined light image having a predetermined flash rate, the predetermined light image is based on material in the waste storage area and is configured to obscure visibility of material in the waste storage area, wherein the predetermined light image has an on state that is longer than an off state.

16. The toilet waste area lighting method of claim 15 further comprising, in the selecting step (A), basing the selection of the at least two light sources on the appearance of toilet waste through the toilet passage during a period when the at least two light sources provide light in the toilet waste container area.

17. The toilet waste area lighting method of claim 15 further comprising, in the selecting step (A), selecting the at least two light sources based on the predetermined light image to be provided by light from the at least two light sources in the toilet waste container area.

18. The toilet waste area lighting method of claim 15 further comprising, in the selecting step (A), selecting a strobing light source.

19. A method of lighting a toilet waste area, comprising:

A. providing a light source in a toilet waste container area in a toilet waste container below a toilet passage;

B. providing power for the light source at least during a portion of user time when the toilet passage is open for use by a user; and C. flashing the light source through an inner lens and an outer lens in a predetermined light image, the predetermined light image is based on material in the waste storage area and is configured to flash at predetermined time intervals, wherein the predetermined light image has an on state that is longer than an off state, and wherein the light image is configured to obscure visibility of material in the waste storage area.

20. The toilet waste area providing method of claim 19 wherein the providing step (A) includes providing the light source aimed at the toilet waste container area.

* * * * *